US006523244B1

(12) United States Patent
Bissonnette

(10) Patent No.: US 6,523,244 B1
(45) Date of Patent: Feb. 25, 2003

(54) ALUMINUM CLOSURE PANEL AND HEMMING METHOD

(75) Inventor: Thomas A. Bissonnette, Lapeer, MI (US)

(73) Assignee: Tesco Engineering, Inc., Auburn Hills, MI (US)

( * ) Notice: Subject to any disclaimer, the term of this patent is extended or adjusted under 35 U.S.C. 154(b) by 0 days.

(21) Appl. No.: 09/499,776

(22) Filed: Feb. 8, 2000

Related U.S. Application Data

(60) Provisional application No. 60/126,717, filed on Mar. 29, 1999.

(51) Int. Cl.[7] ..... B21D 39/00
(52) U.S. Cl. ..... 29/509; 29/243.5
(58) Field of Search ..... 29/243.5, 469.5, 29/509; 428/192; 403/267, 282

(56) References Cited

U.S. PATENT DOCUMENTS

| | | | | |
|---|---|---|---|---|
| 3,481,694 | A | * | 12/1969 | Taylor |
| 4,008,845 | A | * | 2/1977 | Bleckmann |
| 4,131,980 | A | * | 1/1979 | Zinnbauer |
| 4,497,151 | A | * | 2/1985 | Simpson et al. |
| 4,916,284 | A | * | 4/1990 | Petrick |
| 4,971,859 | A | * | 11/1990 | Kimura |
| 5,470,416 | A | * | 11/1995 | Herring et al. |
| 5,587,042 | A | * | 12/1996 | St. Denis |
| 5,749,992 | A | * | 5/1998 | Eklund et al. |
| 5,783,298 | A | * | 7/1998 | Herring et al. |
| 5,830,559 | A | | 11/1998 | Goldbach et al. |
| 5,948,185 | A | * | 9/1999 | Krajewski et al. |
| 6,000,118 | A | * | 12/1999 | Biernat |
| 6,368,008 | B1 | * | 4/2002 | Biernat et al. |

FOREIGN PATENT DOCUMENTS

| | | | |
|---|---|---|---|
| DE | 198 37 792 | | 6/1999 |
| JP | 56-41032 | * | 4/1981 |

OTHER PUBLICATIONS

W.Th.M. Buters and R. Boesenkool, "Bending, Flanging and Hemming of Hylite Sandwich Sheet" Research Disclosure #39602, Apr. 1997, p. 205.*
McGraw–Hill, Product Design and Process Engineering, 1974, pp. 174, 591–600.
Addison–Wesley, Manufacturing Anlaysis, 1966, pp. 112–115.
Prentice–Hall, The Principles of Engineering Materials, 1973, pp. 212, 232 ,269.
Patent Abstracts of Japan, vol. 018, No. 302.

* cited by examiner

*Primary Examiner*—S. Thomas Hughes
*Assistant Examiner*—Steven Blount
(74) *Attorney, Agent, or Firm*—Fildes & Outland, P.C.

(57) ABSTRACT

A method for forming a vehicle closure panel assembly from outer and inner metal preformed panels disposed between lower and upper tools, includes the steps of applying a resilient material between the inner and outer panels around the area of the hem line, nesting the inner panel and outer panels into the lower tool, applying a clamp down force onto the inner panel to cause the resilient material to flow and distribute around the hem line, prehemming the outer panel, and final hemming the inner and outer panels together by over clinching the peripheral edge of the outer panel. With this method, the resilient material absorbs and distributes the final hemming forces and the outer panel peripheral edge springs back to form a flat hem.

6 Claims, 1 Drawing Sheet

ALUMINUM CLOSURE PANEL AND HEMMING METHOD

This application claims the benefit of Provisional application No. 60/126,717, filed Mar. 29, 1999.

FIELD OF THE INVENTION

This invention relates to joining two preformed metal panels together to form a closure panel and more particularly to hemming closure panels made from aluminum material.

BACKGROUND OF THE INVENTION

It is known in the automotive industry to join two metal preformed panels into a unitary hollow structural unit. Typical units of this type include vehicle doors, hoods, and trunk lids. Collectively, these units are referred to as closure panels.

A conventional process of joining the two panels together is referred to as hemming and results in a flange of the outer panel being folded over and gripping the edge of the inner panel. The process is well known.

Typical vehicle closure panels are made of steel. Nested inner and outer panels are hemmed to form a flat hem that connects the panels. These panels have desirable strength and impact absorbing properties.

The automobile industry has substituted materials that are lighter than steel materials where substitution is practical to reduce weight and thereby improve fuel economy. Aluminum, which has been applied in vehicle construction, has desirable strength and impact absorbing properties as well as a desirable weight vis-a-vis steel. However, the processes used to form a flat hem on nested steel panels have not been applied successfully on nested aluminum panels to form a flat hem.

The metallurgical characteristics of the aluminum material cause the outer panel in the area of the hem line or break line to crack during the hemming process. Furthermore, the peripheral edge of the hemmed outer panel springs back partially away from the inner panel, not forming the desired flat hem.

A need exists for a method that provides for the hemming of nested aluminum panels to a flat hem.

SUMMARY OF THE INVENTION

The present invention provides a hemmed aluminum closure panel and method for forming a flat hem on nested aluminum panels without cracking of the outer panel along the hem line.

More specifically, in accordance with an aspect of the invention, a method for forming a vehicle closure panel assembly from outer and inner metal preformed panels disposed between lower and upper tools, includes the steps of:

- applying a resilient material between the inner and outer panels around the area of the hem line;
- nesting said inner panel and said outer panel into said lower tool;
- applying a clamp down force onto the inner panel to cause said resilient material to flow and distribute around the hem line;
- prehemming said outer panel;
- final hemming said inner and outer panels together by over clinching the peripheral edge of said outer panel;
- whereby said resilient material absorbs and distributes the final hemming forces and said outer panel peripheral edge springs back to form a flat hem.

In one embodiment of the invention, applying a resilient material comprises applying the material to the inside surface of the outer panel around the area of the hem line. In another embodiment, applying the resilient material comprises molding a ring of polypropylene around the peripheral edge of the inner panel before nesting the panels together. In yet another embodiment, the step of applying the resilient material comprises applying a hem sealant having resilient properties.

Alternatively, an aluminum wire may be applied around the hem line about the inside surface of the outer panel. The aluminum wire allows the hem pressure to build quicker in the area of the hem during the hemming process, allows the hem to form around the wire and subsequently act as a gap filler in the hemmed closure panel.

The step of final hemming may comprise isolating the bulk of the hemming compression directly on the hem line radius.

These and other features and advantages of the invention will be more fully understood from the following detailed description of the invention taken together with the accompanying drawings.

DETAILED DESCRIPTION OF THE INVENTION

Figure 1:
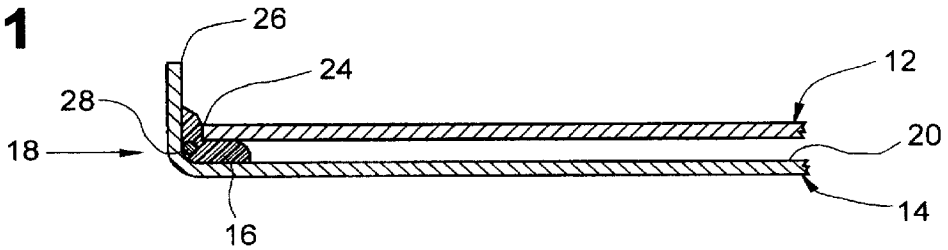
FIG. 1 is an elevational, schematic, partial sectional view of nested upper and lower panels and a resilient material between the panels.

Referring now to the drawings in detail, a method for forming a vehicle closure panel assembly from inner and outer aluminum preformed panels 12, 14 disposed between lower and upper tools, not shown, is disclosed.

According to the method, a resilient material 16 is applied between the inner and outer panels 12, 14 around the area of the hem line 18. The resilient material 16 may be applied to the inside surface 20 of the outer panel 14 around the area of the hem line 18 as illustrated in FIG. 1. In current hemming operations double sided foam tape manufactured by the 3M company and referred to as Y4205 YSN 98091 18 7N has been the resilient material.

Figure 6:
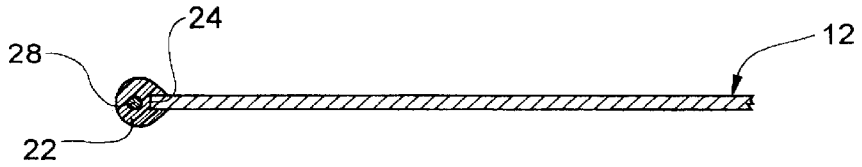
FIG. 6 is an elevational, schematic, partial sectional view of an upper panel illustrated with polypropylene around its peripheral edge.

Alternatively, the resilient material 16 may be a molded ring of polypropylene 22 around the peripheral edge 24 of the inner panel 12, as illustrated. in FIG. 6. In yet another embodiment, the resilient material 16 may be a hem sealant having resilient properties.

An aluminum wire 28 may be applied around the hem line about the inner surface of the outer panel 14 to facilitate the forming of the hem. The aluminum wire 28 may be molded into the polypropelene 22, around the peripheral edge 24 of the inner panel 12. The aluminum wire 28 allows the hem pressure to build quicker during hemming and acts as a gap filler in the hemmed closure panel.

Figure 2:
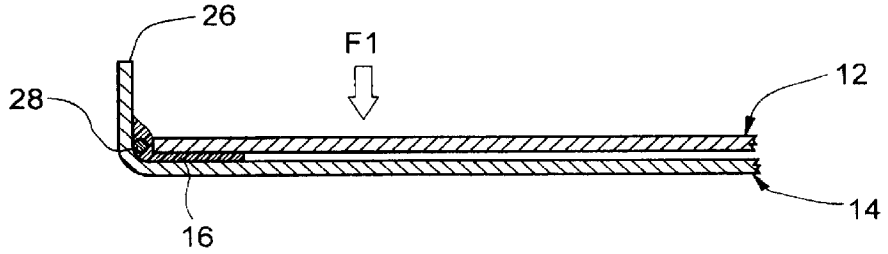
FIG. 2 is an elevational, schematic, partial sectional view of the nested upper and lower panels illustrating the application of a clamp down force causing the resilient material to flow and distribute around the hem line.
Figure 3:
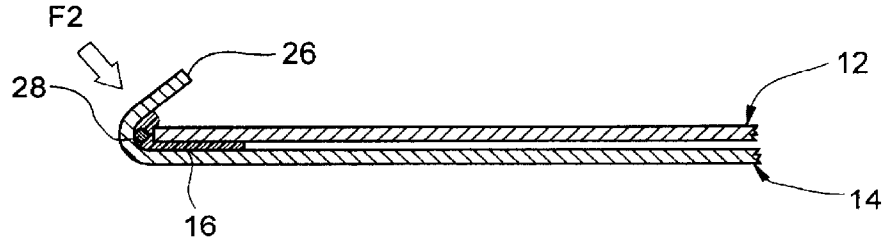
FIG. 3 is an elevational, schematic, partial sectional view of the nested upper and lower panels illustrating the application of a prehemming force being applied to the outer panel.

The inner and outer panels 12, 14 are nested together on the lower tool. A clamp down force F1, illustrated in FIG. 2, is applied onto the top side of the inner panel 12 to cause the resilient material 16 to flow and distribute around the hem line 18 and beyond. The outer panel 14 is then prehemmed as illustrated in FIG. 3 by the application of a prehemming force F2 from the side. Final hemming of the inner and outer panels 12, 14 is accomplished by over clinching the peripheral edge 26 of the outer panel by the application of a downward force F3 applied near to the hem line.

During the final, hemming the resilient material 16 absorbs and distributes the final hemming forces eliminating the hem line cracking associated with earlier attempts to hem aluminum panels together. The resilient material 16 also allows for the over clinching and lets the outer panel peripheral edge 26 spring back to form a flat hem between the hemmed panels.

Figure 4:
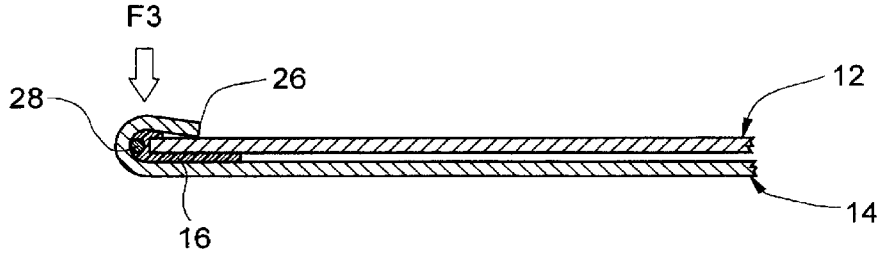
FIG. 4 is an elevational, schematic, partial sectional view of the nested upper and lower panels illustrating the application of a final hemming force being applied to the outer panel and the over clinching of the peripheral edge of the outer panel.
Figure 5:
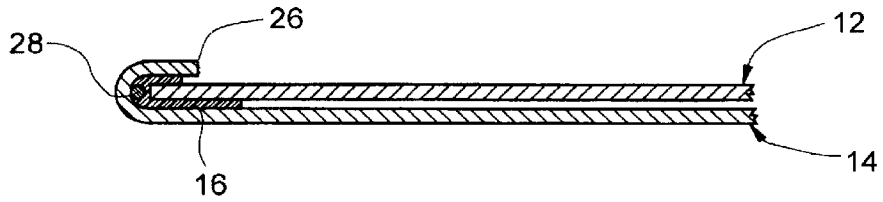
FIG. 5 is an elevational, schematic, partial sectional view of the hemmed upper and lower panels illustrating the flat hem resulting from the over clinching of the outer aluminum panel and the force absorbing and distributing effect of the resilient material.

Preferably, the step of final hemming comprises isolating the bulk of the hemming compression directly on the hem line radius and away from the peripheral edge 26 of the outer panel 14 as is illustrated in FIG. 4.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method for forming an aluminum vehicle closure panel assembly from outer and inner aluminum preformed panels disposed between lower and upper tools, the method comprising the steps of:

applying a resilient material between the inner and outer aluminum panels around the area of a hem line;

nesting said inner panel and said outer panel into said lower tool;

applying a clamp down force onto the inner panel to cause said resilient material to flow and distribute around the hem line;

prehemming said outer panel;

over clinching the peripheral edge of said outer panel to final hem said inner and outer panels together;

whereby said resilient material absorbs and distributes the final hemming forces and said outer panel peripheral edge springs back to form a flat hem.

2. The method of claim 1 further including the step of applying an aluminum wire into said resilient material around the hem line about the inside surface of the outer panel to facilitate hemming around said wire and to act as a gap filler in the hemmed closure panel.

3. The method of claim 1 wherein the step of applying a resilient material comprises applying said material to the inside surface of the outer panel around the area of the hem line.

4. The method of claim 1 wherein the step of applying a resilient material comprises molding a ring of polypropylene around the peripheral edge of the inner panel before nesting said panels together.

5. The method of claim 1 wherein the step of applying a resilient material comprises applying a hem sealant having resilient properties.

6. The method of claim 1 wherein the step of final hemming comprises isolating the bulk of the hemming compression directly on the hem line radius.

* * * * *